US009099071B2

(12) United States Patent
Kim et al.

(10) Patent No.: US 9,099,071 B2
(45) Date of Patent: Aug. 4, 2015

(54) METHOD AND APPARATUS FOR GENERATING SINGING VOICE

(75) Inventors: Eun-kyoung Kim, Suwon-si (KR); Jae-sung Kwon, Suwon-si (KR); Nam-soo Kim, Seoul (KR); Jun-sig Sung, Seoul (KR)

(73) Assignees: SAMSUNG ELECTRONICS CO., LTD., Suwon-si (KR); Seoul National University Industry Foundation, Seoul (KR)

( * ) Notice: Subject to any disclaimer, the term of this patent is extended or adjusted under 35 U.S.C. 154(b) by 110 days.

(21) Appl. No.: 13/278,838

(22) Filed: Oct. 21, 2011

(65) Prior Publication Data

US 2012/0097013 A1 Apr. 26, 2012

Related U.S. Application Data

(60) Provisional application No. 61/405,344, filed on Oct. 21, 2010.

(30) Foreign Application Priority Data

Sep. 26, 2011 (KR) ..... 10-2011-0096982

(51) Int. Cl.
*G10H 1/36* (2006.01)

(52) U.S. Cl.
CPC ..... *G10H 1/366* (2013.01); *G10H 2250/455* (2013.01)

(58) Field of Classification Search
None
See application file for complete search history.

(56) References Cited

U.S. PATENT DOCUMENTS

| | | | | |
|---|---|---|---|---|
| 5,641,927 | A * | 6/1997 | Pawate et al. | 84/609 |
| 7,304,229 | B2 * | 12/2007 | Chang | 84/610 |
| 7,667,126 | B2 * | 2/2010 | Shi | 84/616 |
| 7,842,874 | B2 * | 11/2010 | Jehan | 84/609 |
| 8,244,546 | B2 * | 8/2012 | Nakano et al. | 704/500 |
| 2001/0045153 | A1 * | 11/2001 | Alexander et al. | 84/609 |
| 2003/0233930 | A1 * | 12/2003 | Ozick | 84/610 |
| 2010/0154619 | A1 * | 6/2010 | Taub et al. | 84/616 |
| 2012/0097013 | A1 * | 4/2012 | Kim et al. | 84/610 |
| 2012/0297958 | A1 * | 11/2012 | Rassool et al. | 84/609 |
| 2013/0019738 | A1 * | 1/2013 | Haupt et al. | 84/622 |
| 2013/0025437 | A1 * | 1/2013 | Serletic et al. | 84/634 |

OTHER PUBLICATIONS

"SingBySpeaking" Saitou te al. Feb. 8, 2008.*
"Transformation of Reading to Singing with Favorite Style" Moriyama et al. Feb. 8, 2008.*
Nam Soo Kim, June Sig Sung and Doo Hwa Hong. "Factored MLLR Adaptation," IEEE Signal Processing Letters, vol. 18, No. 2; Feb. 2011 (pp. 99-102).

* cited by examiner

*Primary Examiner* — Marlon Fletcher
(74) *Attorney, Agent, or Firm* — Sughrue Mion, PLLC

(57) ABSTRACT

A method and apparatus of generating a singing voice are provided. The method for generating a singing voice includes: generating a first transformation function representing correlations between average voice data and singing voice data, based on the average voice data and the singing voice data; generating a second transformation function by reflecting music information into the first transformation function; and generating a singing voice by transforming the average voice data by using the second transformation function.

19 Claims, 5 Drawing Sheets

METHOD AND APPARATUS FOR GENERATING SINGING VOICE

CROSS-REFERENCE TO RELATED PATENT APPLICATION

This application claims priority from U.S. Provisional Patent Application No. 61/405,344, filed on Oct. 21, 2010, in the U.S. Patent and Trademark Office, and the benefit of Korean Patent Application No. 10-2011-0096982, filed on Sep. 26, 2011, in the Korean Intellectual Property Office, the disclosures of which are incorporated herein in their entirety by reference.

BACKGROUND

1. Field

Methods and apparatuses consistent with exemplary embodiments relate to generating a singing voice, and more particularly, to generating a singing voice by transforming average voice data of a speaker.

2. Description of the Related Art

In a voice synthesis method using a statistical processing method, a voice signal parameter representing features of a voice is extracted, the parameter is classified into designated units, and then a value that represents each unit the best is estimated. A large amount of voice data is required to allow the units to achieve statistically meaningful values. In general, large cost and effort are required to construct the voice data. In order to solve this problem, an adaptation method is suggested.

The adaptation method aims to represent unit values similar to a level of a voice synthesis method which uses a large amount of voice data, even when the adaptation method uses a small amount of voice data. In order to achieve this goal, the adaptation method uses a transformation matrix.

A generally used method of forming a transformation matrix is a maximum likelihood linear regression (MLLR) method. The transformation matrix represents correlations between voice data and is used to transform units of voice A having a large amount of data to represent features of voice B having a small amount of data based on correlations between the voice A and the voice B.

The MLLR method performs well when transforming voice data between normally spoken general voices, but reduces sound quality when transforming a general voice into a singing voice. This is because the MLLR method does not consider a pitch and duration of a sound, which are important elements of a singing voice. Accordingly, a method of efficiently generating a singing voice by transforming a general voice is required.

SUMMARY

An exemplary embodiment provides a method and apparatus for generating a singing voice by transforming average voice data without reducing sound quality.

Another exemplary embodiment also provides a method and apparatus for efficiently generating a singing voice when using a small amount of singing voice data.

According to an aspect of an exemplary embodiment, there is provided a method of generating a singing voice, the method including generating a first transformation function representing correlations between average voice data and singing voice data, based on the average voice data and the singing voice data; generating a second transformation function by reflecting music information into the first transformation function; and generating a singing voice by transforming the average voice data using the second transformation function.

The generating of the first transformation function may include analyzing the units of the average voice data and the singing voice data; matching the units of the average voice data and the singing voice data; and generating the first transformation function based on correlations between the matched units of the average voice data and the singing voice data.

The matching the units may include matching the units of the average voice data and the singing voice data according to context information.

The generating of the second transformation function may include analyzing lyrics of the music information into units and extracting, from the music information, at least one of a pitch and a duration of a sound corresponding to each of the analyzed units; and generating the second transformation function by reflecting the extracted at least one of the pitch and duration of the sound into the first transformation function.

The generating of the singing voice may include analyzing the units of the average voice data and lyrics of the music information; matching the units of the average voice data and the lyrics; and generating voice signals of the units of the singing voice by transforming voice signals of the matched units of the average voice data by using the second transformation function.

The context information may include information regarding at least one of a position and a length of one unit in a predetermined sentence included in the average voice data and/or the singing voice data, and types of other units previous and subsequent to the one unit.

According to another aspect of an exemplary embodiment, there is provided an apparatus for generating a singing voice, the apparatus including a music information receiver for receiving and storing music information; a transformation function generator for generating a first transformation function representing correlations between average voice data and singing voice data, based on the average voice data and the singing voice data, and generating a second transformation function by reflecting the music information into the first transformation function; and a singing voice generator for generating a singing voice by transforming the average voice data by using the second transformation function.

The apparatus may further include a label generator for analyzing the units of a predetermined sentence.

The label generator may analyze the units of the average voice data and the singing voice data, and the transformation function generator may match the units of the average voice data and the singing voice data, and generate the first transformation function based on correlations between the matched units of the average voice data and the singing voice data.

The label generator may analyze the units of lyrics of the music information, and the transformation function generator may extract, from the music information, at least one of a pitch and a duration of a sound corresponding to each of the analyzed units, and may generate the second transformation function by reflecting the extracted at least one of the pitch and duration of the sound into the first transformation function.

The label generator may analyze the units of the average voice data and lyrics of the music information, the transformation function generator may match units of the average voice data and the lyrics, and the singing voice generator may generate voice signals of the units of the singing voice by transforming voice signals of the matched units of the average voice data by using the second transformation function.

The first transformation function may be generated by using a maximum likelihood (ML) method.

The music information may include score information.

The units may be triphones.

According to another aspect of an exemplary embodiment, there is a non-transitory computer-readable recording medium having recorded thereon a computer program for executing the method.

BRIEF DESCRIPTION OF THE DRAWINGS

The above and other aspects will become more apparent by describing in detail exemplary embodiments thereof with reference to the attached drawings in which.

DETAILED DESCRIPTION OF THE EXEMPLARY EMBODIMENTS

Hereinafter, exemplary embodiments will be described in detail with reference to the attached drawings. In the following description of the exemplary embodiments, a detailed description of known functions and configurations incorporated herein will be omitted when it may make the subject matter of the exemplary embodiment unclear. Exemplary embodiments may, however be embodied in many different forms and should not be construed as being limited to the exemplary embodiments set forth herein; rather, these exemplary embodiments are provided so that this disclosure will be thorough and complete, and will fully convey the inventive concept to those skilled in the art.

As used herein, the term "and/or" includes any and all combinations of one or more of the associated listed items. Expressions such as "at least one of," when preceding a list of elements, modify the entire list of elements and do not modify the individual elements of the list.

Figure 1A:
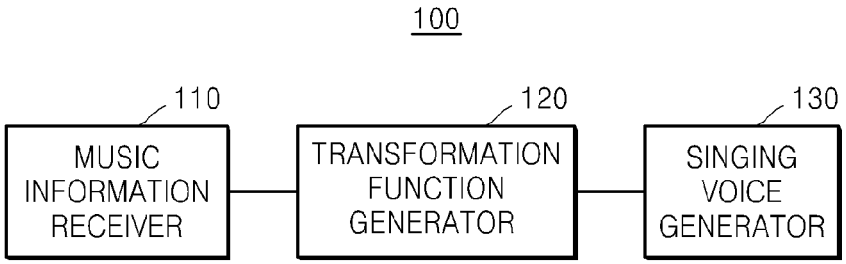
FIG. 1A is a block diagram of an apparatus for generating a singing voice, according to an exemplary embodiment.

FIG. 1A is a block diagram of an apparatus 100 for generating a singing voice, according to an exemplary embodiment.

Figure 1B:
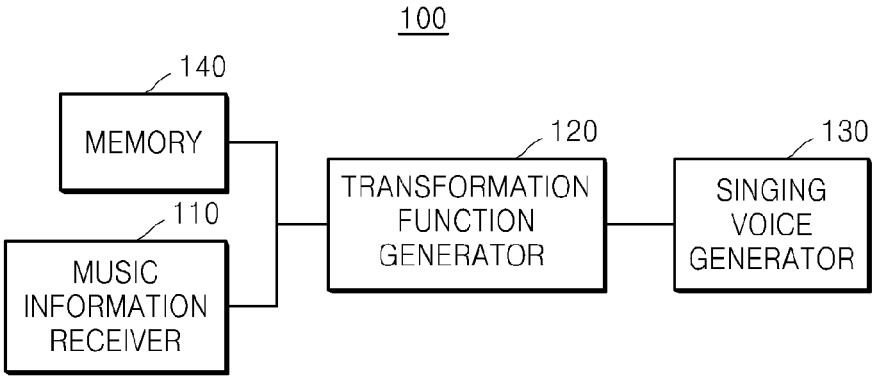
FIG. 1B is a block diagram of an apparatus for generating a singing voice, according to another exemplary embodiment.
Figure 1C:
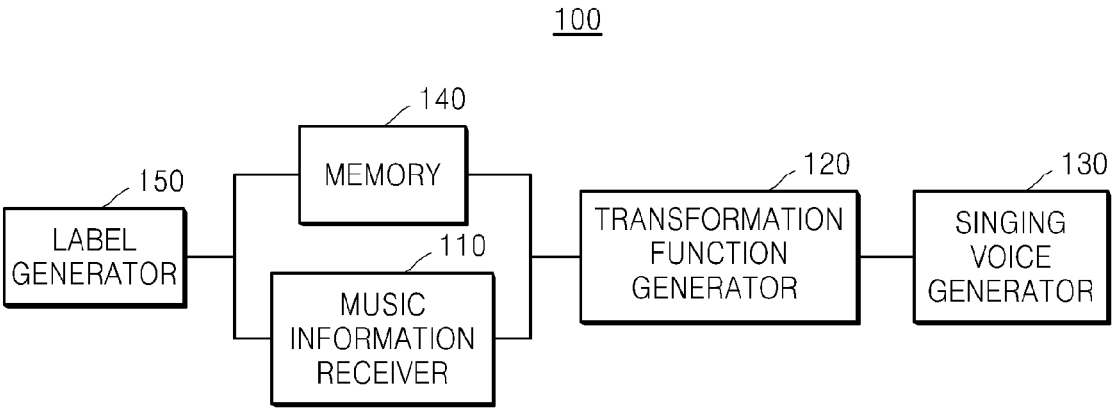
FIG. 1C is a block diagram of an apparatus for generating a singing voice, according to another exemplary embodiment.

Referring to FIG. 1A, the apparatus 100 includes a music information receiver 110, a transformation function generator 120, and a singing voice generator 130. Also, the apparatus 100 may further include a memory 140, as illustrated in FIG. 1B, and may further include a label generator 150, as illustrated in FIG. 1C.

In an exemplary embodiment, "average voice data" refers to data of reading-like voice generated by a speaker, i.e., data obtained by recording a voice of an average person who generally reads predetermined sentences. "Singing voice data" refers to data obtained by recording a voice of an average person who sings predetermined sentences according to musical notes.

The music information receiver 110 receives and stores music information. The music information may be input from outside the apparatus 100. For example, the music information may be input via a wired or wireless Internet, a wired or wireless network connection, and/or via local communication.

The music information may include music lyrics or notes. That is, the music information may include information representing music lyrics, and pitches and/or durations of sounds corresponding to the music lyrics. The music information may also be score information.

The apparatus 100 generates a singing voice corresponding to the music information input to the music information receiver 110, from average voice data.

In more detail, the transformation function generator 120 generates a first transformation function representing correlations between average voice data and singing voice data, based on the average voice data and the singing voice data, and generates a second transformation function by reflecting the music information input to the music information receiver 110, into the first transformation function.

A method of generating the first and second transformation functions will be described in detail below.

The singing voice generator 130 generates a singing voice corresponding to the music information input to the music information receiver 110, by transforming average voice data using the second transformation function generated by the transformation function generator 120.

The memory 140 stores the average voice data and the singing voice data. Also, the memory 140 may further store results of training the general voice data and the singing voice data, or the first transformation function. The memory 140 may be an information input/output device such as a hard disk, flash memory, a compact flash (CF) card, a secure digital (SD) card, a smart media (SM) card, a multimedia card (MMC), or a memory stick. Also, the memory 140 may not be included in the apparatus 100 and may be formed separately from the apparatus 100. In more detail, the memory 140 may be an external server for storing the average voice data and the singing voice data.

In general, the average voice data may be easier to collect than the singing voice data. Accordingly, the memory 140 may store a larger amount of the average voice data in comparison to the singing voice data. Also, the memory 140 may store a larger amount of data resulting from training based on the average voice data in comparison to the data resulting from training based on the singing voice data.

The label generator 150 analyzes the units of the average voice data, the singing voice data, and the lyrics of the music information and generates labels regarding the units.

The labels may include context information regarding each unit included in a predetermined sentence. Here, the "unit" refers to a unit for dividing the predetermined sentence according to voice signals, and one of a phone, a diphone, and a triphone may be used as a unit. For example, if a phone is used as a unit, the labels are generated by dividing the predetermined sentence into phonemes. The apparatus 100 may use a triphone as a unit.

The "context information" includes information regarding at least one of the position and the length of one unit included in the predetermined sentence, and types of other units previous and subsequent to the one unit.

A method of generating the first and second transformation functions will now be described in detail.

Initially, the label generator 150 analyzes the units of the average voice data and the singing voice data.

The transformation function generator 120 matches the units of the average voice data and the singing voice data. The transformation function generator 120 may match the units of the average voice data and the singing voice data having the same or very similar context information.

The transformation function generator 120 generates the first transformation function based on correlations between the matched units of the average voice data and the singing voice data. If voice signals of the units of the average voice data are substituted into the generated first transformation function, voice signals of the units of the singing voice data are generated.

In an exemplary embodiment, a voice signal of a unit includes the voice signal of the unit itself, or a parameter representing features of the voice signal of the unit. That is, if the voice signals of the units of the average voice data themselves, or parameters representing features of the voice signals of the units of the average voice data are substituted into the first transformation function, the voice signals of the units of the singing voice data, or parameters representing features of the voice signals of the units of the singing voice data are calculated.

In general, since the amount of the average voice data is greater than that of the singing voice data, one-to-one matching may not be enabled between the average voice data and the singing voice data. In this case, the first transformation function of unmatched units may be obtained based on correlations between matched units. The first transformation function may be generated by using a maximum likelihood (ML) method.

The first transformation function may be generated by using Equation 1.

$$\hat{\mu}_s = M(\eta)\mu_s + b(\eta) \qquad \text{<Equation 1>}$$

Here, a mean vector $\mu_s$ represents a parameter of a p×1 matrix regarding a voice signal of the average voice data (hereinafter referred to as a first parameter), represents a parameter of a p×1 matrix regarding a voice signal of the singing voice data in which $\mu_s$ is transformed by $M(\eta)$ and $b(\eta)$ (hereinafter referred to as a second parameter). $M(\eta)$ is a p×p regression matrix, and $b(\eta)$ is a bias vector of a p×1 matrix and is a parameter representing a transformation function. Here, p refers to an order. $\eta$ is a variable such as a pitch or duration of a sound. A distribution s is assumed to be a Gaussian of the mean vector $\mu_s$ and a covariance $\Sigma_s$. In addition, $M(\eta)$ and $\Sigma_s$ are assumed to be diagonal as represented in Equations 2.

$$M(\eta) = \mathrm{diag}(w'_1\xi, w'_2\xi, \ldots, w'_p\xi)$$

$$b(\eta) = (v'_1\xi, v'_2\xi, \ldots, v'_p\xi)' \qquad \text{<Equations 2>}$$

Here, $\xi = \Phi(\eta)$ refers to a D-order vector obtained by transforming $\eta$. $\xi_t$ is a control vector transformed at a time t according to $\eta_t$, and is defined as $\xi_t = (1, \log P_t, \log D_t)'$. $P_t$ and $D_t$ respectively represent a pitch and a duration of a sound according to the music information at the time t.

The parameters of $M(\eta)$ and $b(\eta)$ are estimated by using the ML method. For this, an expectation-maximization (EM) algorithm is applied.

If $X = (x_1, x_2, \ldots, x_T)$ is a set of vectors of the second parameter, a posteriori probability of the distribution s at each time in an expectation step is as represented in Equation 3.

$$\gamma_t(s) = Pr(\theta(t) = s \mid X, \lambda) \qquad \text{<Equation 3>}$$

$\theta(t)$ refers to a distribution index at the time t, and $\lambda$ refers to current transformation functions $M(\eta)$ and $b(\eta)$. After the posteriori probability is calculated, in a maximization step, W and V for maximizing likelihood are calculated as represented in Equation 4.

$$\{\hat{W}, \hat{V}\} = \arg\max_{\{W, V\}} L(W, V) = \arg\max_{\{W, V\}} -\frac{1}{2}\sum_{t=1}^{T}\gamma_t(s)\left(\sum_{i=1}^{p}\frac{(x_{t,i} - w'_i\xi_t\mu_{s,i} - v'_i\xi_t)^2}{\sigma^2_{s,i}}\right) \qquad \text{<Equation 4>}$$

Here, a hat (ˆ) marked on W and V at a left term refers to an updated transformation function. i refers to an ith order of each vector. If Equation 4 is calculated with respect to $w_i$ and $v_i$ Equation 5 is obtained.

$$\begin{bmatrix} \left(\sum_{t=1}^{T}\gamma_t(s)\frac{\mu^2_{s,i}}{\sigma^2_{s,i}}\xi_t\xi'_t\right) & \left(\sum_{t=1}^{T}\gamma_t(s)\frac{\mu_{s,i}}{\sigma^2_{s,i}}\xi_t\xi'_t\right) \\ \left(\sum_{t=1}^{T}\gamma_t(s)\frac{\mu_{s,i}}{\sigma^2_{s,i}}\xi_t\xi'_t\right) & \left(\sum_{t=1}^{T}\gamma_t(s)\frac{1}{\sigma^2_{s,i}}\xi_t\xi'_t\right) \end{bmatrix} \begin{bmatrix} \hat{w}_i \\ \hat{v}_i \end{bmatrix} = \begin{bmatrix} \left(\sum_{t=1}^{T}\gamma_t(s)\frac{x_{t,i}\mu_{s,i}}{\sigma^2_{s,i}}\xi_t\right) \\ \left(\sum_{t=1}^{T}\gamma_t(s)\frac{x_{t,i}}{\sigma^2_{s,i}}\xi_t\right) \end{bmatrix} \qquad \text{<Equation 5>}$$

$\gamma_t(s)$ is a posteriori probability calculated in the expectation step, and $x_{t,i}$, $\mu_{s,i}$, and $\sigma 2_{s,i}$ respectively are ith elements of $x_t$, and $\mu_s$.

If the first transformation function is generated as described above, the transformation function generator 120 generates the second transformation function by reflecting the music information into the first transformation function.

In more detail, the label generator 150 analyzes the units of the lyrics of the music information.

The transformation function generator 120 extracts and reflects at least one of a pitch and a duration of a sound corresponding to each of the analyzed units, into the first transformation function. That is, the second transformation function is generated as a transformation function transformed by substituting the pitch and duration of the sound for $P_t$ and $D_t$ of $\xi_t = (1, \log P_t, \log D_t)'$ in Equation 5.

An exemplary method of generating a singing voice from average voice data according to the music information input to the music information receiver 110 will now be described.

The label generator 150 analyzes the units of the average voice data and the lyrics of the music information.

The transformation function generator 120 matches the analyzed units of the average voice data and the lyrics, and generates the second transformation function by extracting and substituting a pitch and a duration of a sound corresponding to each unit of the music information into the previously generated first transformation function.

The singing voice generator 130 generates voice signals of the units of the singing voice by transforming voice signals of the units of the average voice data matched to the units of the music information by using the second transformation function generated by substituting pitches and durations of sounds regarding the units. The singing voice corresponding to the music information is generated by combining the generated voice signals of the singing voice.

Figure 2:
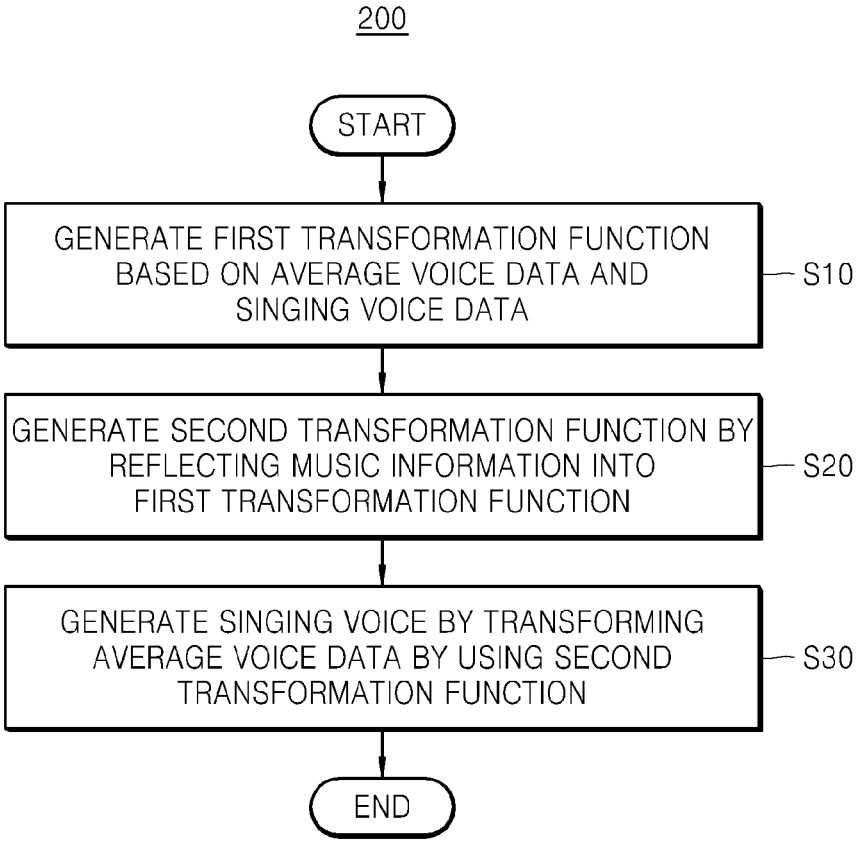
FIG. 2 is a flowchart of a method of generating a singing voice, according to an exemplary embodiment.

FIG. 2 is a flowchart of a method 200 of generating a singing voice, according to an exemplary embodiment.

Referring to FIG. 2, the transformation function generator 120 generates a first transformation function based on average voice data and singing voice data (operation S10).

Then, the transformation function generator 120 generates a second transformation function by reflecting music information input to the music information receiver 110, into the first transformation function (operation S20).

The singing voice generator 130 generates a singing voice corresponding to the music information by transforming the average voice data by using the second transformation function (operation S30).

The method 200 illustrated in FIG. 2 may be performed by the apparatus 100 illustrated in FIG. 1 and includes technical features of operations performed by the elements of the apparatus 100. Accordingly, repeated descriptions thereof are not provided in FIG. 2.

Figure 3:
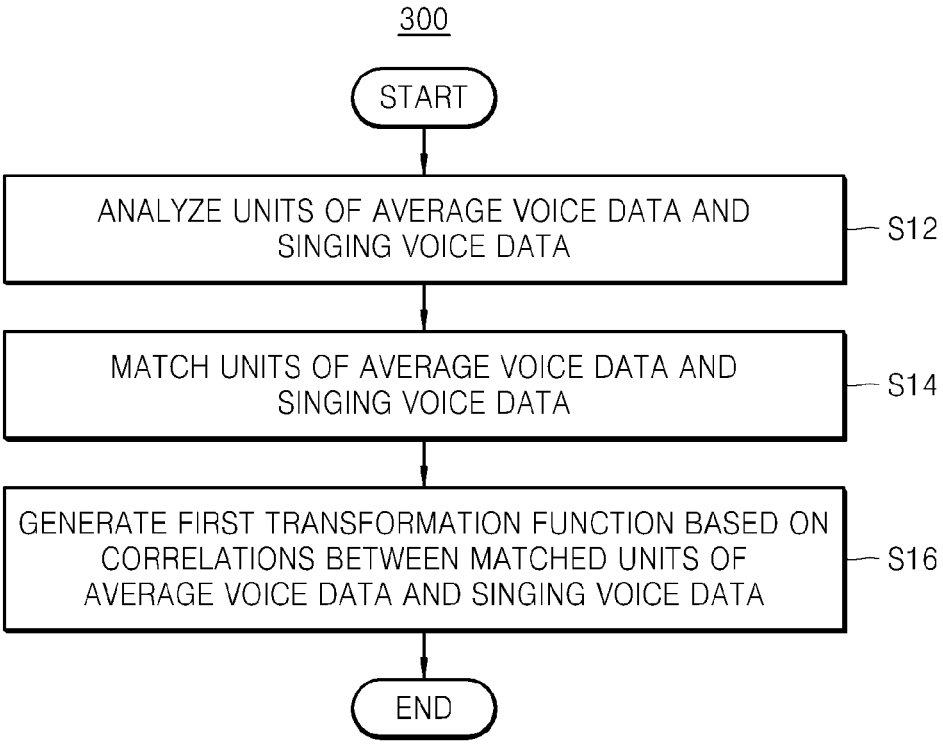
FIG. 3 is a detailed flowchart of operation S10 illustrated in FIG. 2, according to an exemplary embodiment.

FIG. 3 is a detailed flowchart of operation S10 illustrated in FIG. 2, according to an exemplary embodiment.

Initially, the label generator 150 analyzes the units of the average voice data and the singing voice data (operation S12). In the method 300, the units may be triphones.

Then, the transformation function generator 120 matches the units of the average voice data and the singing voice data (operation S14).

The transformation function generator 120 generates the first transformation function based on correlations between the matched units of the average voice data and the singing voice data (operation S16). The first transformation function may be generated by using an ML method. The method of obtaining the first transformation function is described above, and thus will not be described hereinafter.

Figure 4:
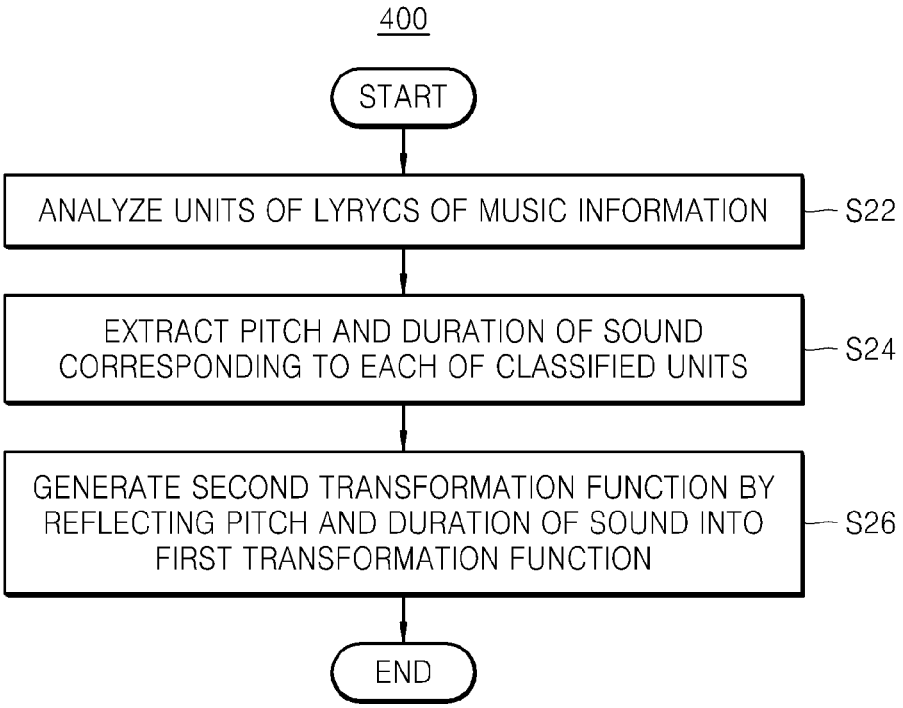
FIG. 4 is a detailed flowchart of operation S20 illustrated in FIG. 2, according to an exemplary embodiment.

FIG. 4 is a detailed flowchart of operation S20 illustrated in FIG. 2, according to an exemplary embodiment.

Initially, the label generator 150 analyzes the units of lyrics of the music information (operation S22).

The transformation function generator 120 extracts, from the music information, at least one of a pitch and a duration of a sound corresponding to each of the analyzed units (operation S24).

The transformation function generator 120 generates the second transformation function by reflecting the extracted at least one of the pitch and duration of the sound into the first transformation function (operation S26).

Figure 5:
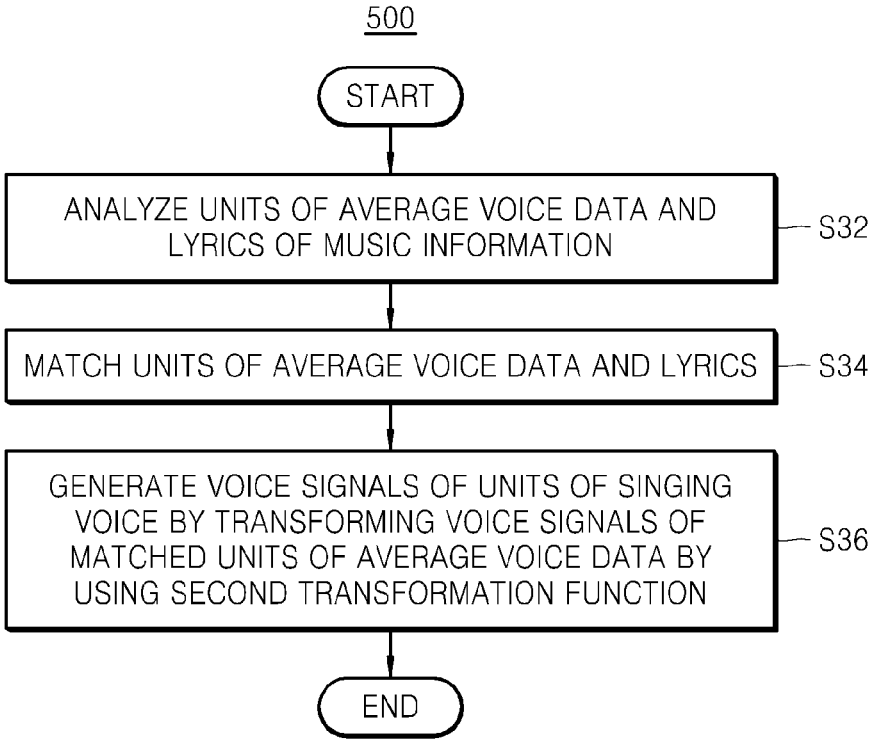
FIG. 5 is a detailed flowchart of operation S30 illustrated in FIG. 2, according to an exemplary embodiment.

FIG. 5 is a detailed flowchart of operation S30 illustrated in FIG. 2, according to an exemplary embodiment.

The label generator 150 analyzes the units of the average voice data and lyrics of the music information (operation S32).

Then, the transformation function generator 120 matches units of the average voice data and the lyrics (operation S34).

The singing voice generator 130 generates voice signals of the units of the singing voice by transforming voice signals of the matched units of the average voice data by using the second transformation function generated by the transformation function generator 120 (operation S36). The singing voice corresponding to the music information is generated by combining the voice signals.

Test Example

In order to prove the performance of a method of generating a singing voice, according to an exemplary embodiment, a test is performed as described below.

Initially, labels are generated based on average voice data that has 1,000 sentences and a duration of 59 minutes, and a classification tree regarding the labels is configured. The average voice data has a sampling rate of 16 kHz and a hamming window that has a length of 20 ms is used at intervals of 5 ms frames to extract voice features. A 25th-order mel-cepstrum is extracted from each frame as a spectrum parameter, a delta-delta parameter is added, and thus a total of 75th-order parameter is obtained. Triphones are used as units. Training is performed based on a five-state left-to-right hidden Markov model (HMM) and the number of nodes of a tree after the training is 1,790.

Singing voice data has a total of 38 pieces of music, has a duration of 29 minutes, and is generated by a speaker of the average voice data. Label generation conditions are the same as those of the average voice data, and a first transformation function is generated based on the singing voice data and the average voice data.

In order to compare performances, a singing voice is generated by using three methods. The first method uses conventional maximum likelihood linear regression (MLLR)-based adaptive training results. For the test, training is performed by using both a full matrix MLLR method and a constraint matrix MLLR method.

As a second method, a singing voice is generated by using singing dependent training (SDT) results generated by using only the 38 pieces of music of the singing voice data. In order to constantly maintain training conditions, units for dependent training are also set as triphones.

As a third method, training results are generated by using a method of generating a singing voice, according to an exemplary embodiment. In this case, training is performed by varying the type of $\xi=\Phi(\eta)$ as represented below.

$$\xi 1=(1,\log \tilde{P},\log \tilde{D})'$$

$$\xi 2=(1,\chi(\tilde{P},P_1),\chi(\tilde{P},P_2),\ldots,\chi(\tilde{P},P_5),\chi(\tilde{D},1))'$$

$$\xi 3=(1,\chi(\tilde{P},1),\chi(\tilde{D},D_1),\chi(\tilde{D},D_2),\ldots,\chi(\tilde{D},D_5))'$$

$$\xi 4=(1,\chi(\tilde{P},P_1),\chi(\tilde{P},P_2),\ldots,\chi(\tilde{P},P_5),\chi(\tilde{D},D_1),\chi(\tilde{D},D_2),\ldots,\chi(\tilde{D},D_5)'$$

$$\chi(a,b)=\exp\left(-\frac{1}{2}(\log a-\log b)^2\right)$$

Here, $P_i$ and $D_i$ are as represented below.

$(P_1, P_2, P_3, P_4, P_5)=(100, 200, 300, 400, 500)$ $(D_1, D_2, D_3, D_4, D_5)=(3, 4, 7, 12, 20)$

State parameters for synthesizing eight pieces of music are selected based on the training results generated by using the methods and are compared to actual voice data. The actual voice data is regarded as an average value of spectrum parameters corresponding to segmentation information of each piece of voice data and is set as a target value.

Figure 6:
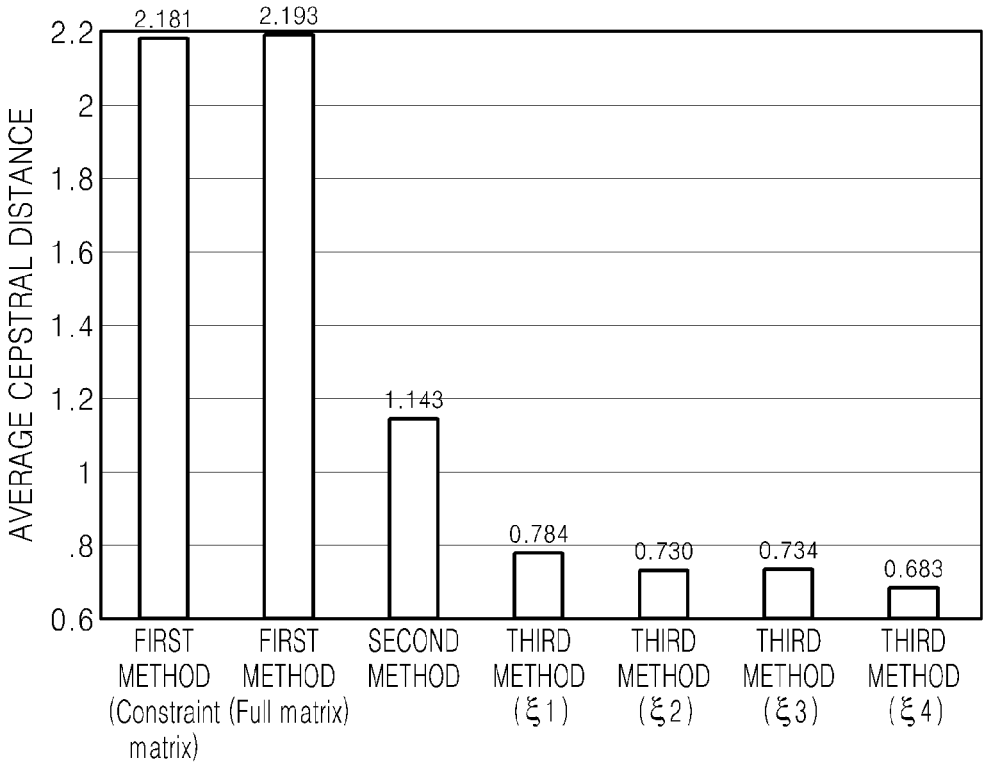
FIGS. 6 and 7 are graphs showing the effect of a method of generating a singing voice, according to an exemplary embodiment.

FIG. 6 is a graph showing results of the above test. In FIG. 6, an average cepstral distance represents a difference between an actual singing voice and singing voices generated by using various methods. If the average cepstral distance is small, the actual singing voice and the generated singing voice are similar to each other.

Referring to FIG. 6, the average cepstral distance between the actual singing voice and the singing voice generated by using a method of generating a singing voice, according to an exemplary embodiment, is 0.784, 0.730, 0.734, or 0.683. As such, the singing voice generated by using a method of generating a singing voice, according to an exemplary embodiment, is the most similar to the actual singing voice in comparison to those generated by using other methods.

Figure 7:
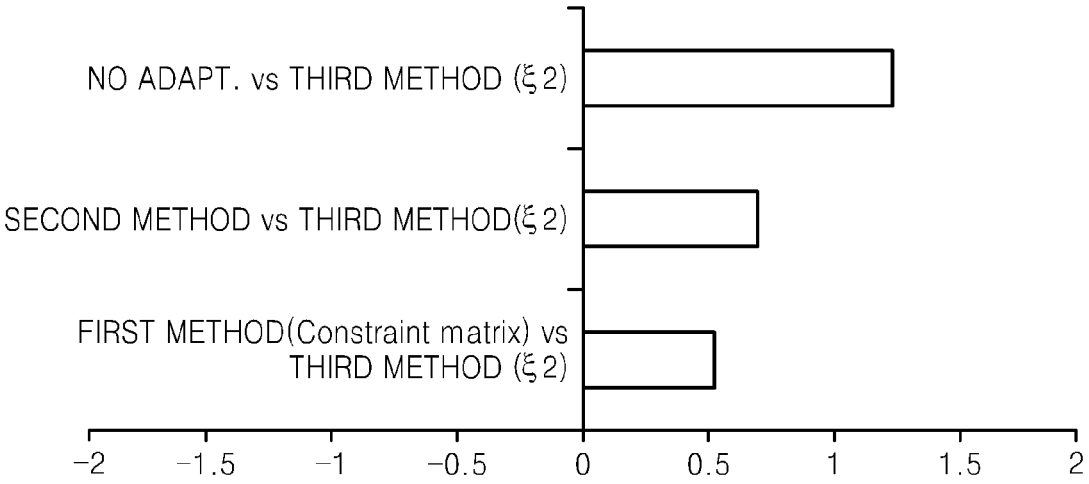

FIG. 7 is a graph showing points given by ten people who listen to the singing voices generated by using various methods. A positive point represents that the singing voice generated by using a method of generating a singing voice, according to an exemplary embodiment, has a good sound quality.

NO ADAPT. represents a method of generating a singing voice by directly transforming average voice data.

Referring to FIG. 7, in comparison to the singing voices generated by the first method, the second method, and the NO ADAPT method, the singing voice generated by using the third method, i.e., a method of generating a singing voice, according to an exemplary embodiment, achieves higher points by the people.

As described above, according to an exemplary embodiment, average voice data may be transformed into a singing voice without reducing sound quality, and a singing voice may be efficiently generated even by using a small amount of singing voice data.

While not restricted thereto, an exemplary embodiment can be embodied as computer-readable code on a non-transitory computer-readable recording medium. The non-transitory computer-readable recording medium is any data storage device that can store data that can be thereafter read by a computer system. Examples of the non-transitory computer-readable recording medium include read-only memory (ROM), random-access memory (RAM), CD-ROMs, magnetic tapes, floppy disks, and optical data storage devices. The non-transitory computer-readable recording medium can also be distributed over network-coupled computer systems so that the computer-readable code is stored and executed in a distributed fashion. Also, an exemplary embodiment may be written as a computer program transmitted over a computer-readable transmission medium, such as a carrier wave, and received and implemented in general-use or special-purpose digital computers that execute the programs. Moreover, one or more units of the apparatus for generating a singing voice can include a processor or microprocessor executing a computer program stored in a computer-readable medium.

While the exemplary embodiments have been particularly shown and described above, it will be understood by those of ordinary skill in the art that various changes in form and details may be made therein without departing from the spirit and scope of the present inventive concept as defined by the following claims.

What is claimed is:

1. A method of generating a singing voice, the method comprising:

generating a first transformation function representing correlations between units of general voice data which indicates reading of sentences and singing voice data, based on the general voice data and the singing voice data;

generating a second transformation function by reflecting music information into the first transformation function; and generating a singing voice by transforming the general voice data by using the second transformation function, wherein the units are triphones.

2. The method of claim 1, wherein the generating of the first transformation function comprises:

analyzing the units of the general voice data and the singing voice data;

matching the units of the general voice data and the singing voice data; and generating the first transformation function based on correlations between the matched units of the general voice data and the singing voice data.

3. The method of claim 2, wherein the matching the units comprises:

matching the units of the general voice data and the singing voice data according to context information.

4. The method of claim 1, wherein the generating of the second transformation function comprises:

analyzing the units of the lyrics of the music information and extracting, from the music information, at least one of a pitch and a duration of a sound corresponding to each of the analyzed units; and generating the second transformation function by reflecting the extracted at least one of the pitch and duration of the sound into the first transformation function.

5. The method of claim 1, wherein the generating of the singing voice comprises:

analyzing the units of the general voice data and lyrics of the music information;

matching the units of the general voice data and the lyrics; and generating voice signals of the units of the singing voice by transforming voice signals of the matched units of the general voice data by using the second transformation function.

6. The method of claim 1, wherein the music information comprises score information.

7. The method of claim 1, wherein the first transformation function is generated by using a maximum likelihood (ML) method.

8. The method of claim 3, wherein the context information comprises information regarding at least one of a position and a length of one unit in a predetermined sentence comprised in the general voice data and/or the singing voice data, and types of other units previous and subsequent to the one unit.

9. A non-transitory computer-readable recording medium having recorded thereon a computer program for executing the method of claim 1.

10. An apparatus which generates a singing voice, the apparatus comprising:

a processor operable to control:

a transformation function generator which generates a first transformation function representing correlations between units of general voice data which indicates reading of sentences and singing voice data, and generates a second transformation function by reflecting music information into the first transformation function; and a singing voice generator which generates a singing voice by transforming the general voice data by using the second transformation function, wherein the units are triphones.

11. The apparatus of claim 10, further comprising a label generator which analyzes the units of a predetermined sentence.

12. The apparatus of claim 11, wherein the label generator analyzes the units of the general voice data and the singing voice data, and wherein the transformation function generator matches the units of the general voice data and the singing voice data, and generates the first transformation function based on correlations between the matched units of the general voice data and the singing voice data.

13. The apparatus of claim 11, wherein the label generator analyzes the units of the lyrics of the music information, and wherein the transformation function generator extracts, from the music information, at least one of a pitch and a duration of a sound corresponding to each of the analyzed units, and generates the second transformation function based upon the extracted at least one of the pitch and duration of the sound into the first transformation function.

14. The apparatus of claim 11, wherein the label generator analyzes the units of the general voice data and lyrics of the music information, wherein the transformation function generator matches the units of the general voice data and the lyrics, and wherein the singing voice generator generates voice signals of the units of the singing voice by transforming voice signals of the matched units of the general voice data by using the second transformation function.

15. The apparatus of claim 10, wherein the first transformation function is generated by using a maximum likelihood (ML) method.

16. The apparatus of claim 10, wherein the music information comprises score information.

17. The apparatus of claim 10, further comprising:

a music information receiver which receives and stores music information.

18. A method of generating a singing voice, the method comprising:

generating a first transformation function representing correlations between a first voice data and a second voice data;

generating a second transformation function by reflecting music information into the first transformation function; and generating a singing voice by transforming the first voice data with the second transformation function, wherein the first voice data is at least one of average voice data and general voice data.

19. The method of claim 18, wherein the second voice data is singing voice data.

* * * * *